US006162035A

United States Patent [19]

Hayano et al.

[11] Patent Number: 6,162,035

[45] Date of Patent: Dec. 19, 2000

[54] HELICAL-BLADE FLUID MACHINE

[75] Inventors: Makoto Hayano; Hirotsugu Sakata; Akira Morishima; Masao Ozu, all of Tokyo, Japan

[73] Assignee: Kabushiki Kaisha Toshiba, Kawasaki, Japan

[21] Appl. No.: 09/165,122

[22] Filed: Oct. 2, 1998

[30] Foreign Application Priority Data

Oct. 3, 1997 [JP] Japan ..... 9-271635
Oct. 22, 1997 [JP] Japan ..... 9-289847

[51] Int. Cl.[7] ..... F04C 2/00

[52] U.S. Cl. ..... 418/220; 418/94; 418/151; 418/55.1; 417/410.5; 417/410.3

[58] Field of Search ..... 418/220, 94, 151, 418/55.1; 417/410.5, 410.3

[56] References Cited

U.S. PATENT DOCUMENTS 4,871,304 10/1989 Iida et al. .
5,174,737 12/1992 Sakata et al. .
5,332,377 7/1994 Hirayama et al. ..... 418/220
5,542,832 8/1996 Sone et al. ..... 418/152

FOREIGN PATENT DOCUMENTS 11148466 6/1999 Japan ..... 418/220

*Primary Examiner*—Thomas Denion
*Assistant Examiner*—Thai-Ba Trieu
*Attorney, Agent, or Firm*—Foley & Lardner

[57] ABSTRACT

A helical-blade fluid machine maintains a low-pressure atmosphere in a closed casing (1) and secures a proper lubrication state for a compression mechanism (9). The fluid machine has a drive mechanism (7) that is installed at an upper or lower part of the casing and consists of a stator (11) and a rotor (15). The compression mechanism is installed at the other part of the casing. The compression mechanism has a cylinder (23) and a roller (25), which is swayed with respect to the cylinder by the drive mechanism. A helical blade (39) having unequal pitches is arranged on the roller, to define compression chambers (41). This arrangement lowers the head of lubricant. An intake pipe (5) feeds gas into the casing so that a low-pressure atmosphere fills the casing.

17 Claims, 8 Drawing Sheets

HELICAL-BLADE FLUID MACHINE

BACKGROUND OF THE INVENTION

1. Field of the Invention

The present invention relates to a helical-blade fluid machine applicable to compressors, expansion machines, pumps, etc.

2. Description of the Prior Art

A helical-blade fluid machine has, in a closed casing, a cylinder and a roller piston eccentrically arranged in the cylinder. The peripheral surface of the roller piston has a helical groove in which a helical blade is inserted to define compression chambers in the cylinder. Relative motion between the cylinder and the roller piston draws coolant gas from an intake end of the cylinder into the compression chambers and successively conveys and compresses the gas toward a discharge end of the cylinder. The compressed gas fills the casing and is discharged outside.

Generally, the helical-blade fluid machine directly draws gas into a compression mechanism, compresses the gas therein, once discharges the compressed gas into the casing, and sends the gas outside through a discharge pipe attached to the casing. As a result, the casing must contain a high-pressure atmosphere. The compression mechanism intrinsically has a long axis that needs long bearings.

The compression mechanism is conventionally designed to partly submerge in a lubricant pool in the casing. This dissolved much coolant in the lubricant under the high-pressure atmosphere, thereby increasing the temperature of the lubricant and decreasing the viscosity thereto to improperly lubricate the long bearings of the compression mechanism.

The coolant may be an HFC-based high-pressure coolant, which has a very high saturation pressure. For example, the saturation pressure of R410A is about 1.5 times higher than that of conventional R22. The casing of the fluid machine must withstand such high pressure. Namely, the casing must have a thick wall, which increases the weight as well as cost of the fluid machine.

When the roller of the compression mechanism in the lubricant pool is driven, it stirs the lubricant, to destabilize the supply of the lubricant, thereby destabilizing the torque and total operation of the compression mechanism.

SUMMARY OF THE INVENTION

An object of the present invention is to provide a helical-blade fluid machine capable of isolating lubricant from high pressure and high temperature and properly lubricating sliding parts of a compression mechanism.

Another object of the present invention is to provide a helical-blade fluid machine having a casing that is thin and light.

Still another object of the present invention is to provide a helical-blade fluid machine having a roller that does not stir lubricant, thereby securing the stable operation of a compression mechanism.

Still another object of the present invention is to provide a helical-blade fluid machine capable of separating coolant gas from coolant liquid, preventing a compression mechanism from drawing the coolant liquid, to prevent an overload operation, avoiding the coolant gas from being heated, and securing efficient compressing conditions.

In order to accomplish the objects, an aspect of the present invention provides a helical-blade fluid machine having a closed casing, a cylinder arranged in the casing, a roller eccentrically arranged in the cylinder, a helical blade having unequal pitches to define compression chambers between the cylinder and the roller so that the volumes of the compression chambers gradually decrease in an axial direction, a drive mechanism for swaying the roller with respect to the cylinder, to axially move each of the compression chambers so that the volume of the compression chamber gradually decreases to compress gas contained therein, an intake pipe connected to the casing to guide gas into the casing and fill the casing with a low-pressure atmosphere, and a discharge pipe communicating with a discharge-end one of the compression chambers, to guide compressed gas from the discharge-end compression chamber to the outside of the casing.

The cylinder, roller, and helical blade form a compression mechanism, which is driven by the drive mechanism. The drive mechanism is electrical and is disposed under the compression mechanism.

The compression mechanism may draw gas from a lower part thereof and compresses the gas in the compression chambers while conveying the gas upwardly.

The compression mechanism may draw gas from the peripheral face of the cylinder into the compression chambers.

The compression mechanism may draw gas from a lower part of the roller into the compression chambers.

This fluid machine isolates gas drawn into the machine from lubricant and efficiently feed the gas into the compression chambers. The lubricant is under a low-pressure atmosphere containing the gas drawn into the casing, and therefore, is free from high pressure or high temperature. As a result, the lubricant maintains proper viscosity to smoothly lubricate bearings that are axially long. The low-pressure atmosphere in the casing enables the casing to have a thin wall to reduce the weight thereof. The roller never agitates the lubricant, thereby stabilizing the operation of the compression mechanism.

The present invention prevents lubricant that has lubricated the bearings from dropping onto a rotor of the drive mechanism and being scattered thereby. To realize this, a lubricant passage is formed through a first support frame that supports a rotating shaft of the compression mechanism. The lubricant that has lubricated the bearings of the compression mechanism passes through the lubricant passage and drops on or around a stator of the drive mechanism.

The fluid machine may have a first volume chamber in the cylinder and a second volume chamber above the cylinder. The first and second volume chambers communicate with each other, isolate discharged gas from lubricant, muffle noise, and reduce passage resistance.

The cross-sectional area of the first volume chamber may be tapered to widen toward the second volume chamber.

A check valve may be arranged in a port between the first and second volume chambers, to prevent a reverse flow from the second volume chamber toward the first volume chamber.

To secure a sealed state for a long time between a high-pressure area and a low-pressure area, an annular seal may be arranged around the second volume chamber or around an end face of the roller. The center of the annular seal is aligned with the center of the shaft.

It is preferable in this case that the bottom of the second volume chamber serves as a bearing to support the top end of the shaft.

In the fluid machine, a second support frame has a bearing for supporting the top of the shaft. To surely lubricate a top part of the compression mechanism, a lubricant passage axially formed through the shaft and a bearing space formed between the top end of the shaft and the bearing of the second support frame are used to lubricate the bearing of the second support frame.

The lubricant passage axially formed through the shaft is shifted from the axis of the shaft so that lubricant may smoothly rise in the passage due to centrifugal force.

To properly lubricate sliding parts of the compression mechanism, the lubricant passage formed through the shaft is connected to a lower part of the bearing of the first support frame and an upper part of the bearing of the roller.

To prevent the vibratory rotation of the drive mechanism, the shaft is shared by the drive mechanism and compression mechanism, and an end of the shaft passed through the drive mechanism is supported by a third support frame.

To balance the compression mechanism with centrifugal force, first and second balancers are attached to the shaft in the roller of the compression mechanism.

To prevent gas from being heated or from catching lubricant, the compression mechanism may be constituted to draw gas from an upper part thereof and compress the gas while conveying it downwardly.

To surely seal a high-pressure part from a low-pressure part in a compressed gas discharging area, a seal may be arranged on the discharge side of the roller of the compression mechanism.

To provide a muffling effect, a volume chamber communicating with a discharge-end one of the compression chambers may be formed at the periphery of the cylinder of the compression mechanism.

To minimize the lengths of power-supply wires, a terminal fitting for supplying power to the drive mechanism may be attached to the casing in a space that is formed on the casing and faces the cylinder of the compression mechanism.

The terminal fitting may be arranged at a cut of the first support frame that supports the shaft of the compression mechanism.

To always lubricate an Oldham ring for swaying the roller of the compression mechanism without rotating the same, the Oldham ring may be arranged between the bottom face of the roller and a lubricant passage area, which is formed on the first support frame to drop lubricant on or around the stator of the drive mechanism.

Another aspect of the present invention provides a helical-blade fluid machine having a compression mechanism composed of a cylinder, a roller, and a helical blade, a drive mechanism for driving the compression mechanism, and a casing for accommodating the compression and drive mechanism in such a way as to simplify the structure of the machine and prevent the vibratory rotation of the drive mechanism. The fluid machine draws gas into the casing, compresses the gas in the compression mechanism, and discharges the compressed gas outside the casing. The compression mechanism is positioned above the drive mechanism. The compression mechanism and drive mechanism share a shaft that is rotatively supported by two support frames arranged on opposite sides of the drive mechanism.

Still another aspect of the present invention provides a helical-blade fluid machine having a compression mechanism composed of a cylinder, a roller, and a helical blade, a drive mechanism for driving the compression mechanism, and a casing accommodating the compression and drive mechanisms. The fluid machine draws gas into the casing through an intake pipe to fill the casing with a low-pressure atmosphere. The compression mechanism is arranged at a lower part of the casing, and the drive mechanism at an upper part thereof.

This fluid machine draws gas into the casing through the intake pipe to fill the casing with a low-pressure atmosphere so that the pressure and temperature of the atmosphere do not affect lubricant and so that the lubricant may secure proper viscosity. Since the compression mechanism is arranged at a lower part of the casing, the head of lubricant from the bottom of the casing is short to smoothly lubricate bearings and the compression mechanism. The casing may have a thin wall to reduce the weight thereof.

To prevent coolant liquid from being directly sent into compression chamber together with coolant gas, the intake pipe may be arranged in a space above the drive mechanism so that the coolant liquid may be gasified by heat.

A rotary plate may be attached to the top of a rotor of the drive mechanism, to spin off coolant liquid sent with coolant gas through the intake pipe.

The intake pipe may be arranged between the drive mechanism and the compression mechanism so that coolant gas may cool the drive mechanism and improve the efficiency of the fluid machine.

The compression mechanism may draw gas from an upper part thereof and discharge it from a lower part thereof, to improve a gas drawing efficiency.

An intake port of the compression mechanism may be formed on the peripheral wall of a balancer chamber which is formed inside the roller and in which a balancer attached to a shaft rotates, so that gas may be sent into the compression mechanism with centrifugal force.

The intake port may communicate with the casing through the balancer chamber and an intake passage formed in the shaft.

The intake passage formed in the shaft may have a separator for separating gas from lubricant.

The intake passage formed in the shaft may have a check valve to allow only a form from the casing toward the intake passage.

DETAILED DESCRIPTION OF THE EMBODIMENTS

Figure 1:
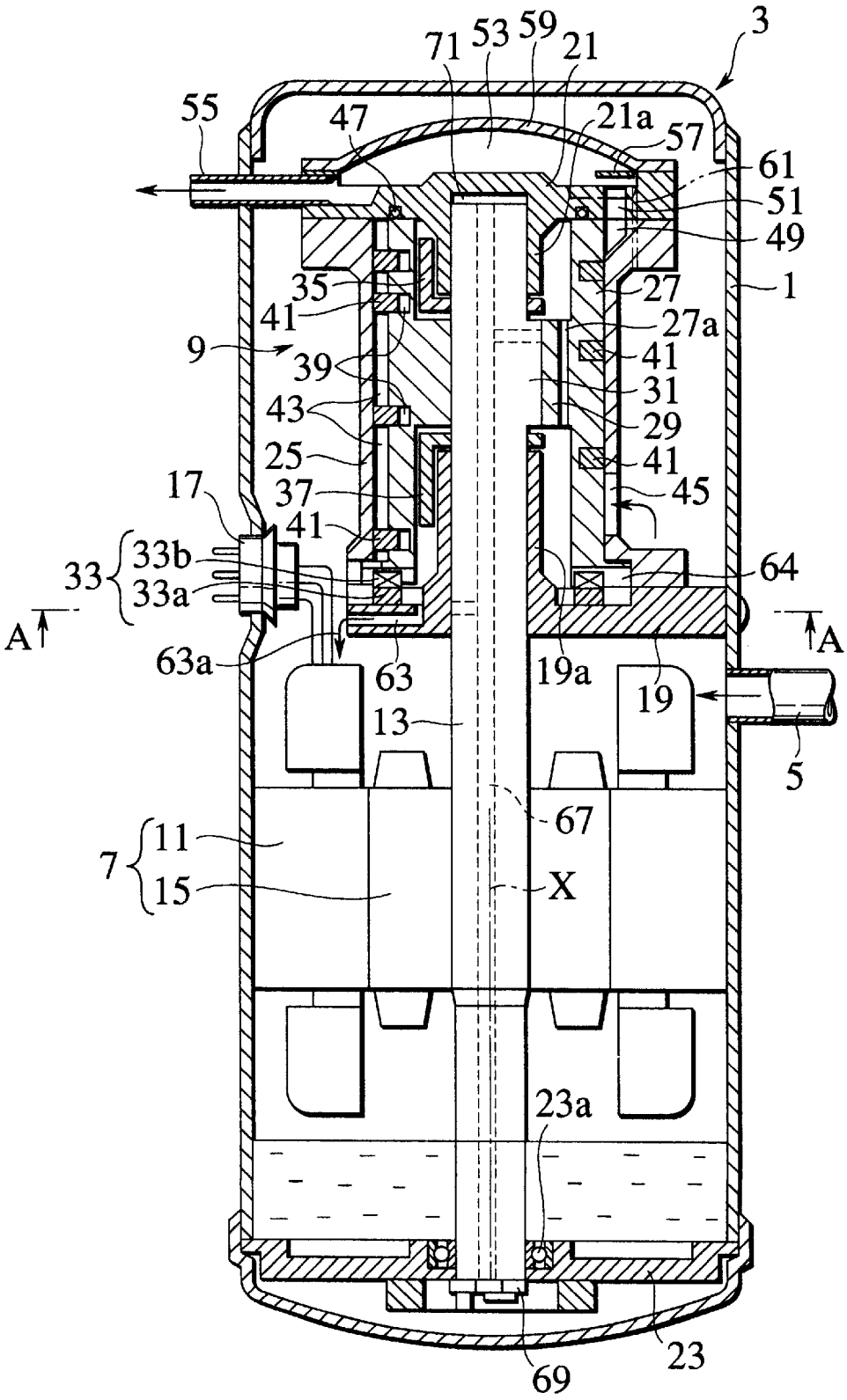
FIG. 1 is a sectional view showing a helical-blade fluid machine according to an embodiment of the present invention.

A helical-blade fluid machine according to an embodiment of the present invention will be explained with reference to FIGS. 1 and 2.

The fluid machine 3 is used in a refrigerating cycle and has a closed casing 1. The casing 1 has an intake pipe 5 and incorporates a drive mechanism 7 and a compression mechanism 9 that is arranged above the drive mechanism 7.

The drive mechanism 7 consists of a stator 11 fixed to the inner wall of the casing 1, and a rotor 15 fixed to a rotating shaft 13. The stator 11 is energized from a terminal fitting 17, to drive the rotor 15, which drives the shaft 13.

The shaft 13 also serves for the compression mechanism 9. The shaft 13 is rotatively supported at three positions. Namely, a first support frame 19 is fixed to the inner wall of the casing 1 and has a bearing 19*a* for supporting an intermediate part of the shaft 13. A second support frame 21 is fixed to the inner wall of the casing 1 and has a bearing 21*a* for supporting a top part of the shaft 13. A third support frame 23 is fixed to the inner wall of the casing 1 and has a bearing 23*a* for supporting a bottom part of the shaft 13. The shaft 13 has an eccentric part 21 to which gas load is applied. Since the gas load is borne by the first and second support frames 19 and 21, the third bearing 23*a* may be omitted in terms of bearing the gas load.

The compression mechanism 9 has a cylinder 25 whose bottom and top ends are fixedly supported by the first and second support frames 19 and 21. The cylinder 25 incorporates a roller 27 that extends along the axis of the cylinder 25. The roller 27 has a bearing 29 that is fitted to the eccentric part 31 of the shaft 13. The roller 27 is swayed without rotating by an Oldham ring 33 so that part of the peripheral face of the roller 27 is linearly in contact with the inner peripheral face of the cylinder 25.

A pair of balancers 35 and 37 are fixed to the shaft 13 in the roller 27 on opposite sides of the eccentric part 31, to balance with centrifugal force created by the eccentric part 31. The second balancer 37 may be arranged on the top end of the rotor 15 to thin the balancer 37 and decrease a wind loss. The peripheral face of the roller 27 has a helical groove 39 whose largest pitch is at an intake end (the lower side of FIG. 1) and whose pitches gradually decrease toward a discharge end (The upper side of FIG. 1).

The groove 39 receives a helical blade 41, which freely moves inwardly and outwardly in the groove 39 due to resiliency and gas pressure. The helical blade 41 defines compression chambers 43 among which one at the intake end has the largest volume. The volumes of the compression chambers 43 gradually decrease toward the discharge end. Gas is drawn from an intake port 45 formed at a lower part of the cylinder 25 and is compressed in the compression chambers 43 while being conveyed upwardly.

The intake pipe 5 is arranged between the stator 11 and the first support frame 19 so that returned coolant liquid cools the drive mechanism 7 and is separated from returned coolant gas. This prevents the coolant liquid from being compressed in the compression chambers 43.

The intake pipe 5 is arranged below the first support frame 19 away from the intake port 45, so that returned coolant liquid may not directly be sent into the intake port 45, to prevent an overload operation. At the same time, coolant gas is directly drawn into a first one of the compression chambers 43, to prevent the gas from being heated and achieve high efficiency.

A last one of the compression chambers 43 at the discharge end communicates with a first volume chamber 49 and is sealed from an inner space of the roller 27 by an annular seal 47. The seal 47 is resiliently supported in the second support frame 21 that is in contact with the top end of the roller 27.

The seal 47 may consist of a resilient member disposed in an annular groove formed on the second support frame 21 and an annular member disposed between the resilient member and the top of the roller 27.

The center of the annular seal 47 is aligned with the axis of the shaft 13 so that a resultant thrust force applied to the roller 27 always agrees with the axis of the shaft 13 and so that the shaft 13 stably supports the thrust force and reduces a slide loss. The seal 47 may be arranged at the top edge of the roller 27 that is in contact with the second support frame 21.

The first volume chamber 49 communicates with a large second volume chamber 3 through a port 51. The second volume chamber 53 communicates with a discharge pipe 55 that extends to the outside of the casing 1.

The sectional area of the first volume chamber 49 may be tapered to widen toward the port 51, to reduce a fluid passage loss.

An exit of the port 51 is provided with a check valve 57 that prevents gas in the second volume chamber 53 from reversely flowing into the first volume chamber 49 when the compression operation is stopped.

The second volume chamber 53 has a muffling function and a lubricant separating function. The bottom of the second volume chamber 53 is the second supporting frame 21 and the top thereof is a cover 59 fixed to the second support frame 21. As indicated with an imaginary line, a lubricant passage 61 or a capillary tube extends from the second volume chamber 53, to smoothly return separated lubricant to the bottom of the casing 1, thereby recycling lubricant in the casing 1.

The Oldham ring 33 consists of a ring 33*a* and a projection 33*b*. The ring 33*a* faces part of a lubricant passage 63 formed on the first support frame 19. The projection 33*b* engages with a recess 64 formed on the bottom end of the roller 27. The Oldham ring 33 is lubricated with lubricant that flows through the passage 63.

The passage 63 has a discharge end 63*a*, which is positioned above the stator 11 of the drive mechanism 7 so that lubricant may not drop directly onto the rotor 15.

Figure 2:
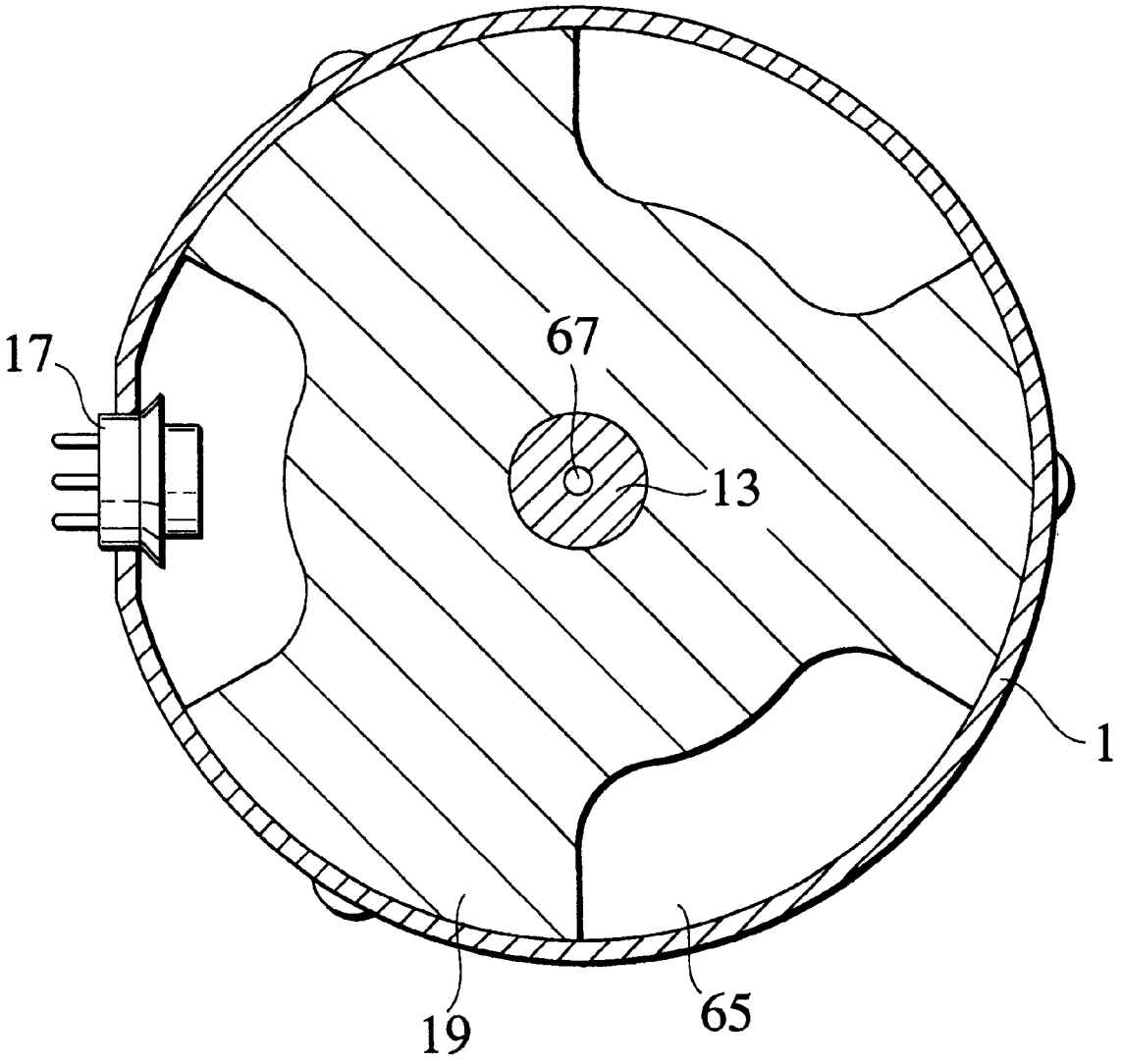
FIG. 2 is a sectional view taken along a line A—A of FIG. 1.

In FIG. 2, the terminal fitting 17 for supplying a current to the stator 11 is attached to the peripheral face of the casing 1 and is received in a recess 65 formed on the first support frame 19.

The shaft 13 has an axial lubricant passage 67 into which a pump 69 feeds lubricant. The pump 69 is installed at the bottom of the casing 1. The passage 67 is eccentric with respect to the axis of the shaft 13 so that centrifugal force may improve the head efficiency of lubricant. The passage 67 communicates with the bearing 19*a* of the first support frame 19, the bearing 21*a* of the second support frame 21, and the bearing 29 of the roller 27.

The bearing 21*a* receives lubricant from the lubricant passage 67 through a bearing space 71 formed on top of the shaft 13. Instead, the bearing 21*a* may receive lubricant directly from the passage 67. Lubricant at the bottom of the casing 1 is pumped up by the pump 69 and is fed into the bearing space 71 to surely lubricate the bearing 21*a*.

Figure 3:
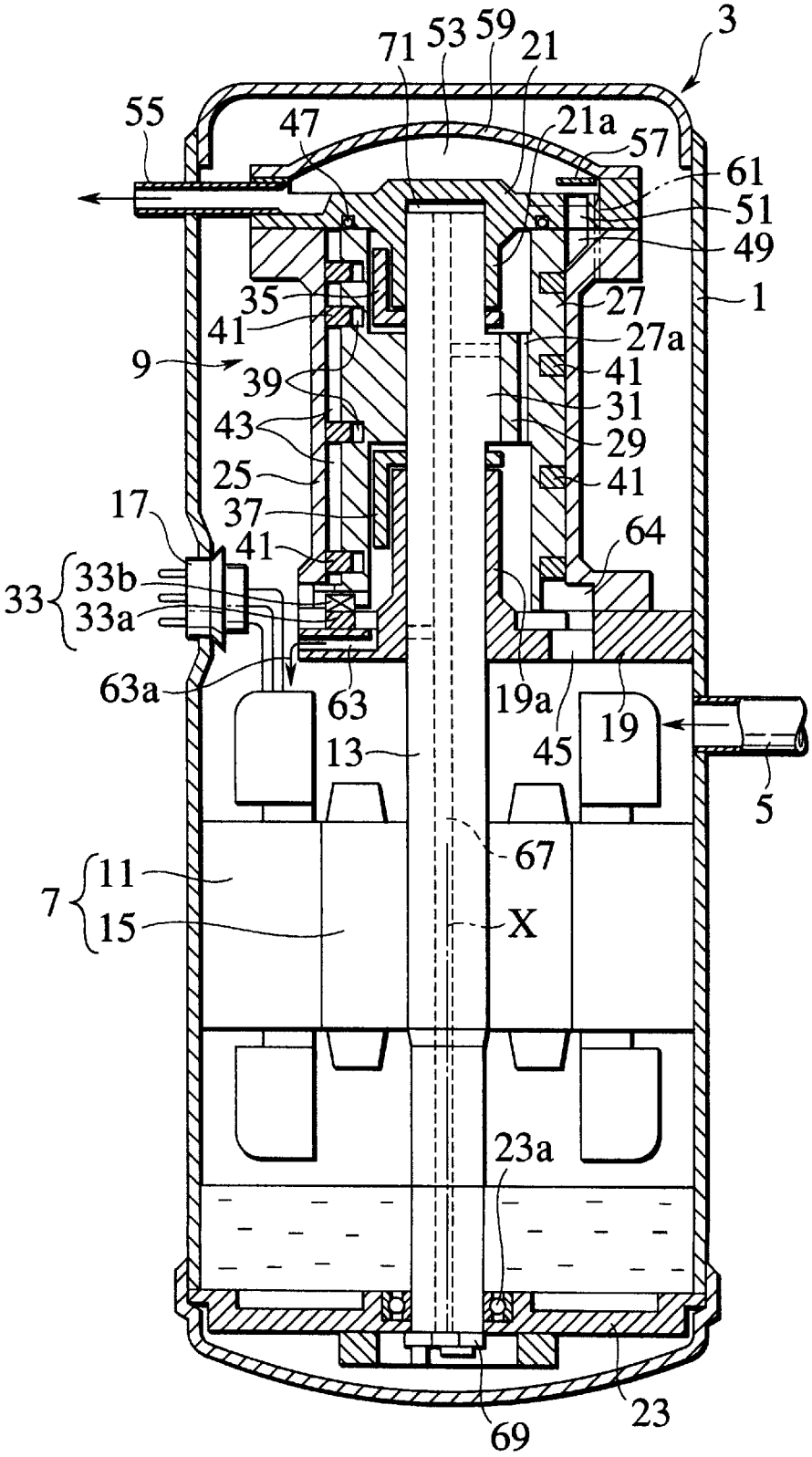
FIG. 3 is a sectional view showing a modification based on the fluid machine of FIG. 1 with an intake port being formed on the first support frame.

The roller 27 has a through hole 27*a* at the eccentric part 31 so that lubricant that has lubricated the bearing 21*a* passes through the hole 27*a* and flows downwardly. The lubricant passage for the eccentric part 31 is formed at an upper part of the part 31 so that lubricant flows downwardly therefrom. On the other hand, the lubricant passage for the bearing 19*a* is formed at a lower part thereof so that lubricant flows upwardly therefrom. Thereafter, the lubricant lubricates the bottom of the roller 27 and the projection 33*b*, i.e., the sliding part of the Oldham ring 33, passes through the passage 63, and returns to the bottom of the casing 1 without being picked up by the rotor 15. Lubricant in the casing 1 repeats a cycle of feeding, lubricating, and returning, to secure lubrication reliability. FIG. 3 shows a modification based on the fluid machine of FIG. 1. This modification forms the intake port 45 on the first support frame 19.

Since the intake port 45 is at a lower part of the compression mechanism 9, gas drawn into the casing 1 will not be heated, to improve compression efficiency.

Figure 4:
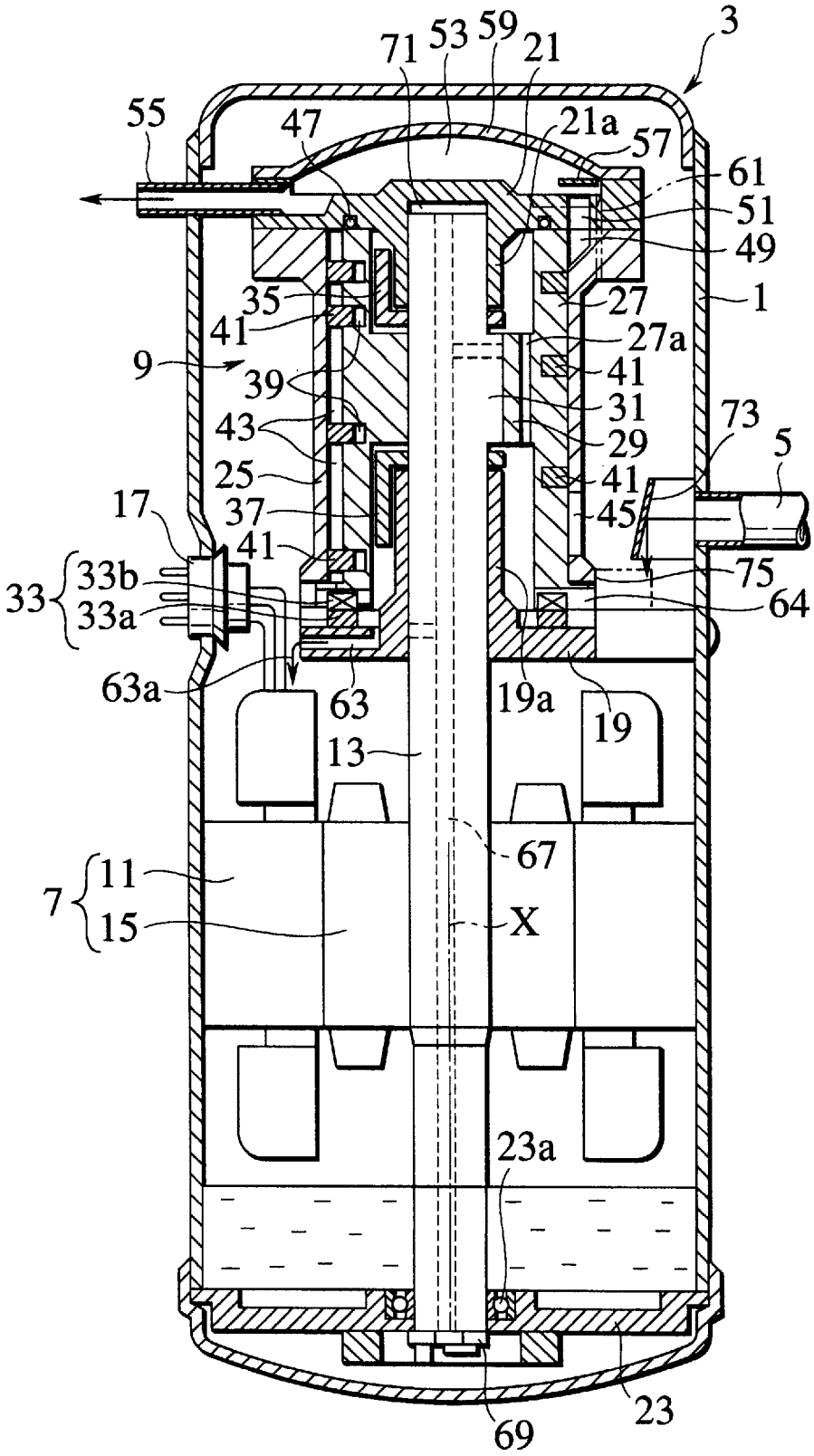
FIG. 4 is a sectional view showing another modification based on the fluid machine of FIG. 1 with an intake port and an intake pipe facing each other.

FIG. 4 shows another modification based on the fluid machine of FIG. 1. This modification arranges the intake pipe 5 in front of the intake port 45 and attaches a guide plate 73 to the intake pipe 5. The guide plate 73 guides gas downwardly, and at the same time, separates the gas from liquid.

As indicated with an imaginary line, the cylinder 25 may have a cut 75 under the intake port 45, and the intake pipe 5 may be arranged in front of the cut 75. This arrangement eliminates the guide plate 73.

Similar to the guide plate 73, the cut 75 is inclined and widened downwardly, to make coolant liquid easily drop and separate from coolant gas.

Figure 5:
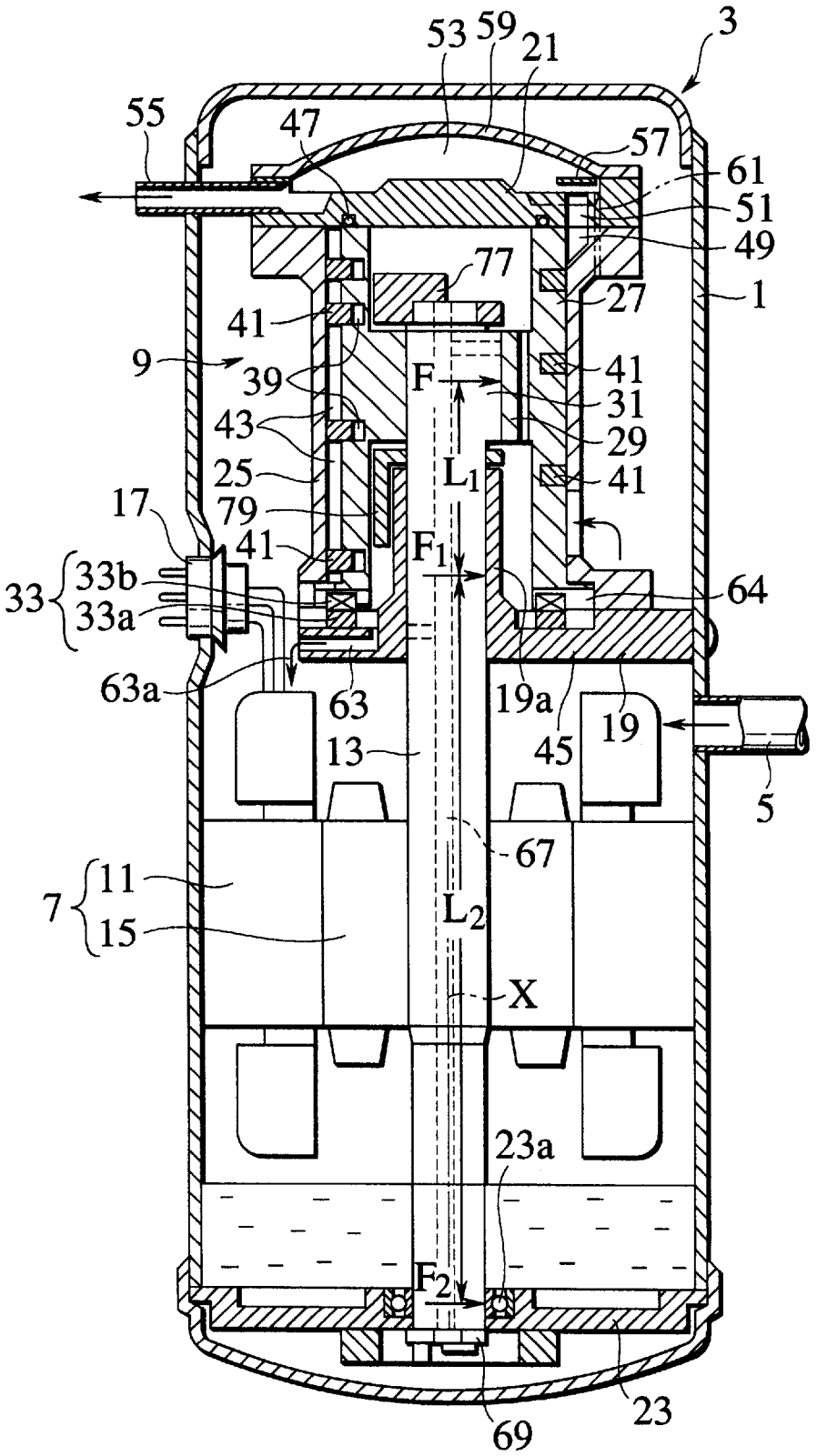
FIG. 5 is a sectional view showing still another modification based on the fluid machine of FIG. 1 with a second support frame being omitted and with a shaft being rotatively supported by first and third support frames.

FIG. 5 shows still another modification based on the fluid machine of FIG. 1. This modification supports the shaft 13 at two positions.

Namely, the shaft 13 passing through the compression mechanism 9 and drive mechanism 7 is supported by the first support frame 19 and third support frame 23. The second support frame 21 has no bearings for supporting the shaft 13.

A first balancer 77 and a second balancer 79 are fixed to the shaft 13 on opposite sides of the eccentric part 31. The first balancer 77 at the top of the shaft 13 is positioned in a large space and may have an optional shape to minimize a wind loss.

Other elements of FIG. 5 are the same as those of FIG. 1, and therefore, are represented with like reference numerals and are not explained again.

The modification shown in FIG. 5 provides an additional effect that gas load generated in the compression chambers 4 is borne by the eccentric part 31 of the shaft 13, which is supported by the first and third support frames 19 and 23. When the shaft 13 must be elongated to serve for a long compression mechanism of a helical-blade compressor, the distance between the support frames 19 and 23 may be extended to reduce load on the frame 19 and 23 as follows:

$$F \times L1 = F2 \times L2 \quad (1)$$

$$F + F2 = F1 \quad (2)$$

where F is load applied to the eccentric part 31, F1 is load borne by the support frame 19, F2 is load borne by the support frame 23, L1 is the distance between the eccentric part 31 and the support frame 19, and L2 is the distance between the support frame 19 and the support frame 23.

The left side of the expression (1) is constant, and therefore, the larger the distance L2, the smaller the load F2. The expression (2) indicates that the smaller the load F2, the smaller the load F1. Since the support frames 19 and 23 bear load, the bearing 21*a* of the second support frame 21 can be omitted. As a result, the fluid machine of FIG. 5 is easy to assemble.

Figure 6:
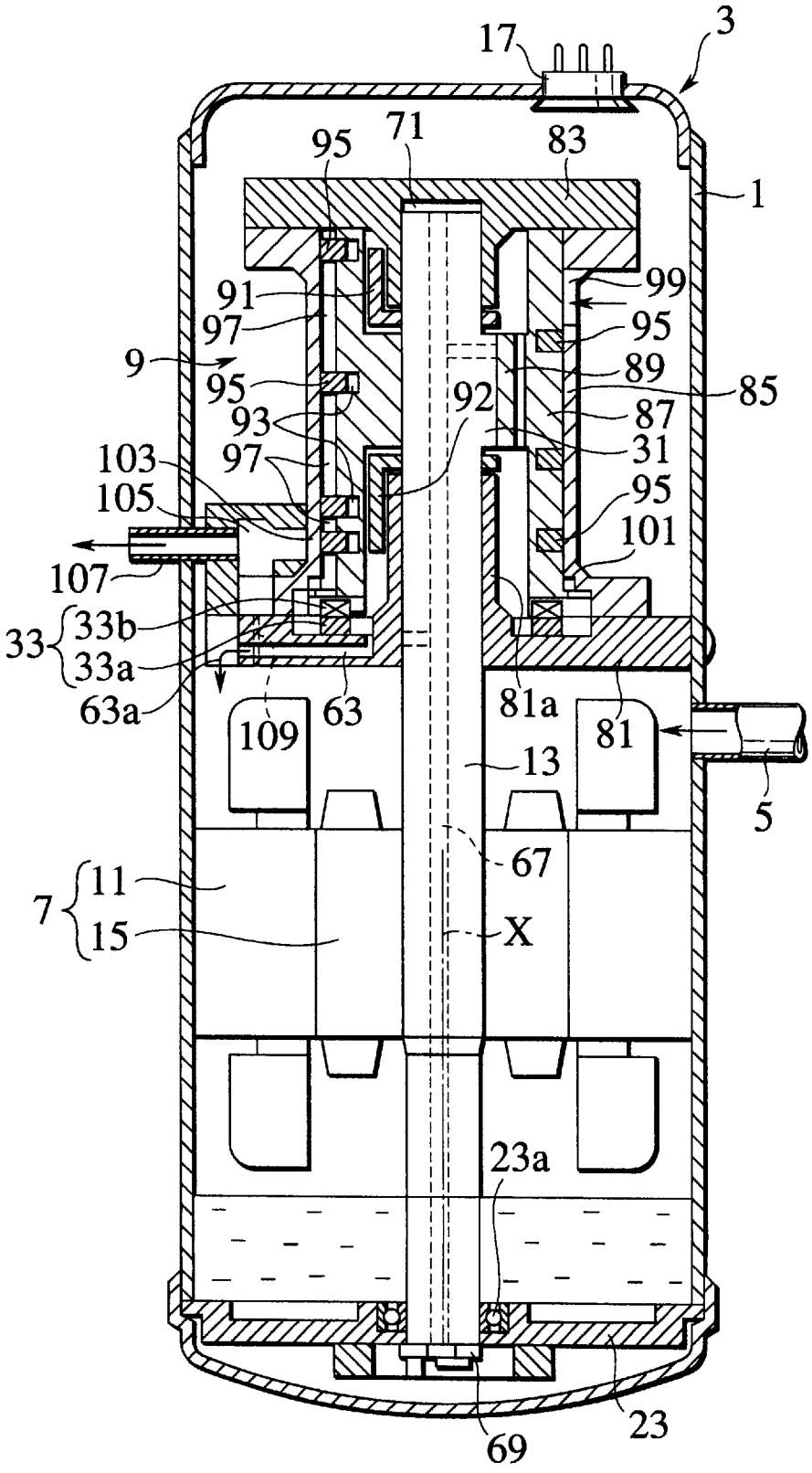
FIG. 6 is a sectional view showing still another modification based on the fluid machine of FIG. 1 with a compression mechanism being structured to compress gas while conveying the gas from top to bottom.

FIG. 6 shows still another modification based on the hydraulic machine of FIG. 1. This modification draws gas from an upper part of the compression mechanism 9 and compresses the gas while conveying the gas downwardly.

The compression mechanism 9 has a cylinder 85 whose bottom and top are fixed to first and second support frames 81 and 83. The cylinder 85 incorporates a roller 87 that is axially extended. The roller 87 has a bearing 89 that is fitted to the eccentric part 31 of the shaft 13. The roller 87 is swayed without rotating by the Oldham ring 33 so that part of the peripheral face of the roller 87 is linearly in contact with the inner peripheral face of the cylinder 85.

A pair of balancers 91 and 92 are fixed to the shaft 13 in the roller 87 on opposite sides of the eccentric part 31, to balance with centrifugal force created by the eccentric part 31. The peripheral face of the roller 87 has a helical groove 93 whose largest pitch is at an intake end (the upper side of FIG. 6) and whose pitches gradually decrease toward a discharge end (the lower side of FIG. 6).

The groove 93 receives a helical blade 95, which freely moves inwardly and outwardly in the groove 93 due to resiliency and gas pressure. The helical blade 95 defines compression chamber 97 among which one at the intake end has the largest volume. The volumes of the compression chambers 97 gradually decrease toward the discharge end. Gas is drawn from an intake port 99 formed at an upper part of the cylinder 85 and is compressed in the compression chambers 97 while being conveyed downwardly.

A last one of the compression chambers 97 at the discharge end communicates with a first volume chamber 103 and is sealed by an annular seal 101 that is arranged between the roller 87 and the cylinder 85.

The first volume chamber 103 communicates with a large second volume chamber 105. The second volume chamber 105 communicates with a discharge pipe 107 that extends to the outside of the casing 1.

The second volume chamber 105 has a muffling function and a lubricant separating function.

As indicated with an imaginary line, a lubricant passage 109 or a capillary tube extends from the second volume chamber 105 to smoothly return separated lubricant to the bottom of the casing 1.

Other elements of FIG. 6 are the same as those of FIG. 1, and therefore, are represented with like reference numerals and are not explained again.

The modification shown in FIG. 6 sends gas from the intake pipe 5 to the intake port 99 and into the compression chambers 97, which compress the gas downwardly. Since the intake port 99 is far from the intake pipe 5, coolant liquid from the intake pipe 5 never enters the intake port 99, to thereby prevent an overload operation. Since the intake port 99 is at an upper part of the compression mechanism 9, gas drawn into the casing 1 is not heated, thereby improving volume efficiency.

In this modification, gas load acting on the shaft 13 mainly occurs around the discharge end of the compression mechanism 9 where the pitches of the blade 95 are narrow.

Namely, the gas load acts near the drive mechanism 7. This means that a force such as a bending force working on the shaft 13 is smaller than that when the discharge port is formed at an upper part of the compression mechanism 9. As a result, the modification of FIG. 6 reduces bearing load, improves the reliability of the fluid machine, and decreases a loss.

Compressed gas discharged from the compression chambers 97 is passed through the first and second volume chambers 103 and 104 and is discharged outside through the discharge pipe 107. These volume chambers 103 and 107 muffle noise caused by the discharged gas.

The lubricant passage 67 lubricates bearings 81*a* and 83*a* of the first and second support frames 81 and 83, to stabilize rotation for a long time.

Figure 7:
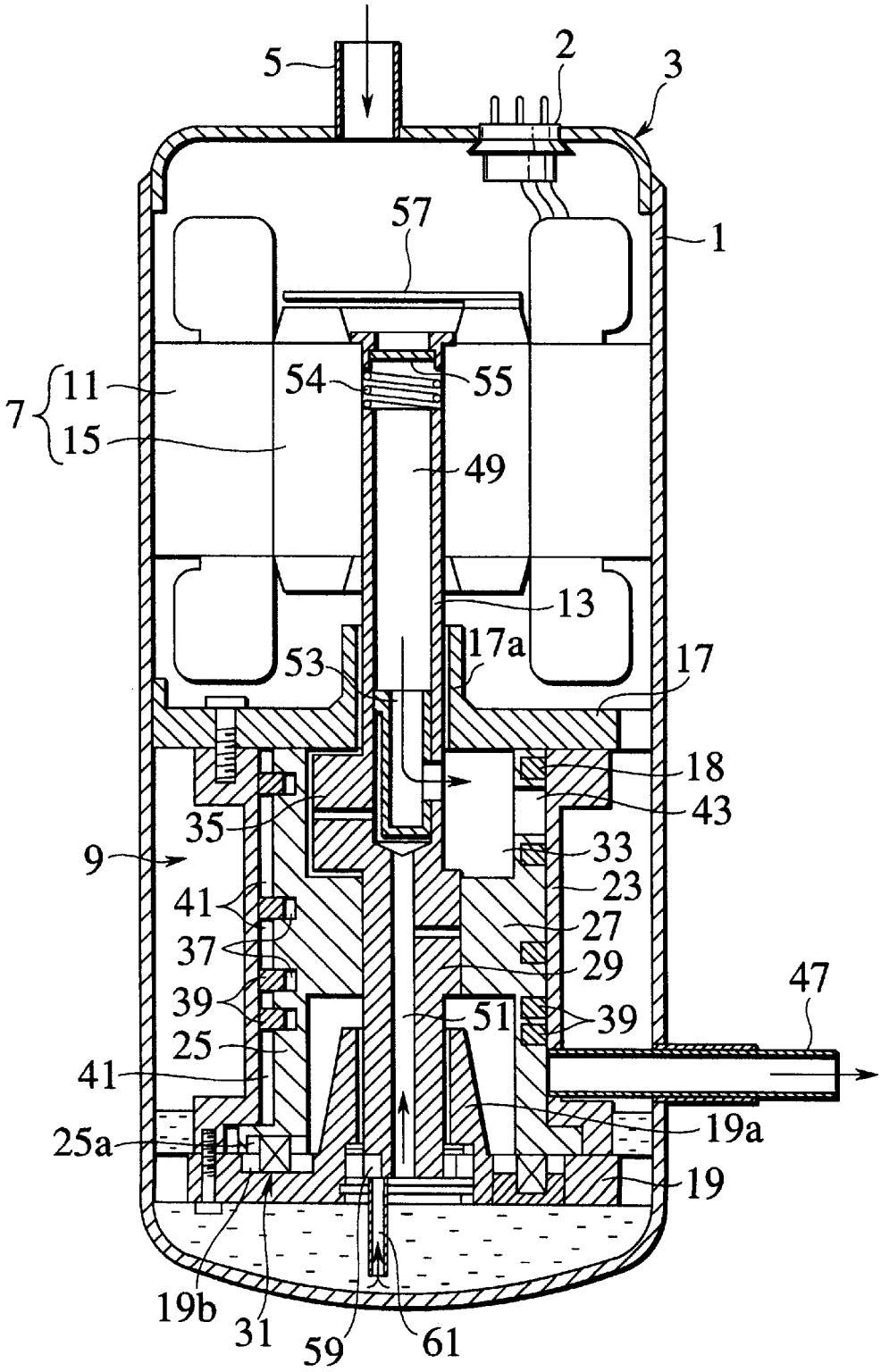
FIG. 7 is a sectional view showing a helical-blade fluid machine according to another embodiment of the present invention.

FIG. 7 shows a helical-blade fluid machine according to another embodiment of the present invention.

The fluid machine 3 serves as a compressor and has a closed casing 1. The top of the casing 1 has an intake pipe 5 of a refrigerating cycle. The casing 1 incorporates a drive mechanism 7 at an upper part of the casing 1 and a compression mechanism 9 at a lower part thereof.

The drive mechanism 7 consists of a stator 11 fixed to the inner wall of the casing 1, and a rotor 15 fixed to a rotating shaft 13. The stator 11 is energized through a terminal fitting 2, to drive the rotor 15, which drives the shaft 13.

The shaft 13 also serves for the compression mechanism 9. The shaft 13 has a vertical long shape. A main bearing frame 17 is fixed to the inner wall of the casing 1 and has a bearing 17*a* for supporting an intermediate part of the shaft 13. A secondary bearing frame 19 is fixed to the inner wall of the casing 1 and has a bearing 19*a* for supporting a bottom end of the shaft 13

The compression mechanism 9 has a cylinder 23 whose top and bottom ends are fixedly supported by the bearing frames 17 and 19. The cylinder 23 incorporates a roller 25 that extends along the axis of the cylinder 23. The roller 25 has a bearing 27 that is fitted to an eccentric part 29 of the shaft 13. The roller 25 is swayed without rotating by an Oldham ring 31 so that part of the peripheral face of the roller 25 is linearly in contact with the inner peripheral face of the cylinder 23.

A balancer 25 is disposed in a balancer chamber 33 formed in the roller 25 on the 180-degree opposite side of the eccentric part 29, to balance with centrifugal force created by the eccentric part 29. The balancer 35 is shaped to decrease a wind loss. The peripheral face of the roller 25 has a helical groove 37 whose largest pitch is at an intake end (the upper side of FIG. 7) and whose pitches gradually decrease toward a discharge end (the lower side of FIG. 7).

The groove 37 receives a helical blade 39, which freely moves inwardly and outwardly in the groove 39 due to resiliency and gas pressure. The helical blade 39 defines compression chamber 41 among which one at the intake end has the largest volume. The volumes of the compression chambers 41 gradually decrease toward the discharge end. Gas is drawn from an intake port 43 formed on the peripheral face of the balancer chamber 33 and is compressed in the compression chambers 41 while being conveyed downwardly.

A last one of the compression chambers 41 is connected to and communicates with a discharge pipe 47 that extends to the outside of the casing 1.

The intake port 43 communicates with the inside of the casing 1 through an intake passage 49 that runs along the axis of the shaft 13.

The intake passage 49 is formed in an upper half of the shaft 13, and a lower half of the shaft 13 is a lubricant passage 51.

The lubricant passage 51 is continuous to the intake passage 49 for manufacturing convenience. The intake passage 49 is larger than the lubricant passage 51 in diameter. A separator 53 is arranged in the intake passage 49, to separate the intake passage 49 from the lubricant passage 51.

A check valve 55 is arranged at the top of the intake passage 49. The check valve 55 is pushed upwardly by a spring 54 to allow only a flow from the casing 1 toward the intake passage 49. A rotary plate 57 is fixed to the rotor 15, to cover the check valve 55 and rotate with the rotor 15.

The lubricant passage 51 communicates with an oil pump 59 arranged under the shaft 13. The pump 59 pumps up lubricant, which is passed through a pipe 61 and the lubricant passage 51 to lubricate sliding parts.

The Oldham ring 31 engages with a recess 25*a* formed on the bottom edge of the roller 25 and with a recess 19*b* formed on the secondary bearing frame 19, to sway the roller 25 without rotating the same.

Coolant gas is sent into the casing 1 through the intake pipe 5. The gas is passed through the intake passage 49, balancer chamber 33, and intake port 43 and is fed into the compression chambers 41, which compress the gas while conveying the same from top to bottom.

Coolant liquid sent with the coolant gas into the casing 1 through the intake pipe 5 is never directly drawn into the compression chambers 41. More precisely, the coolant liquid is gasified by the heat of the drive mechanism 7 or is spun off by the rotary plate 57, and therefore, no coolant liquid is drawn into the compression chambers 41, thereby preventing an overload operation.

When the fluid machine 3 is stopped, the check valve 55 blocks a flow of gas from the intake passage 49 to the casing 1.

Lubricant pumped up by the pump 59 is supplied to the sliding parts through the lubricant passage 51. At this time, the lubricant is free from high temperature or high pressure. Since the compression mechanism 9 is at a lower part of the fluid machine 3, the head of lubricant is low to surely lubricate the bearings and compression mechanism 9.

Figure 8:
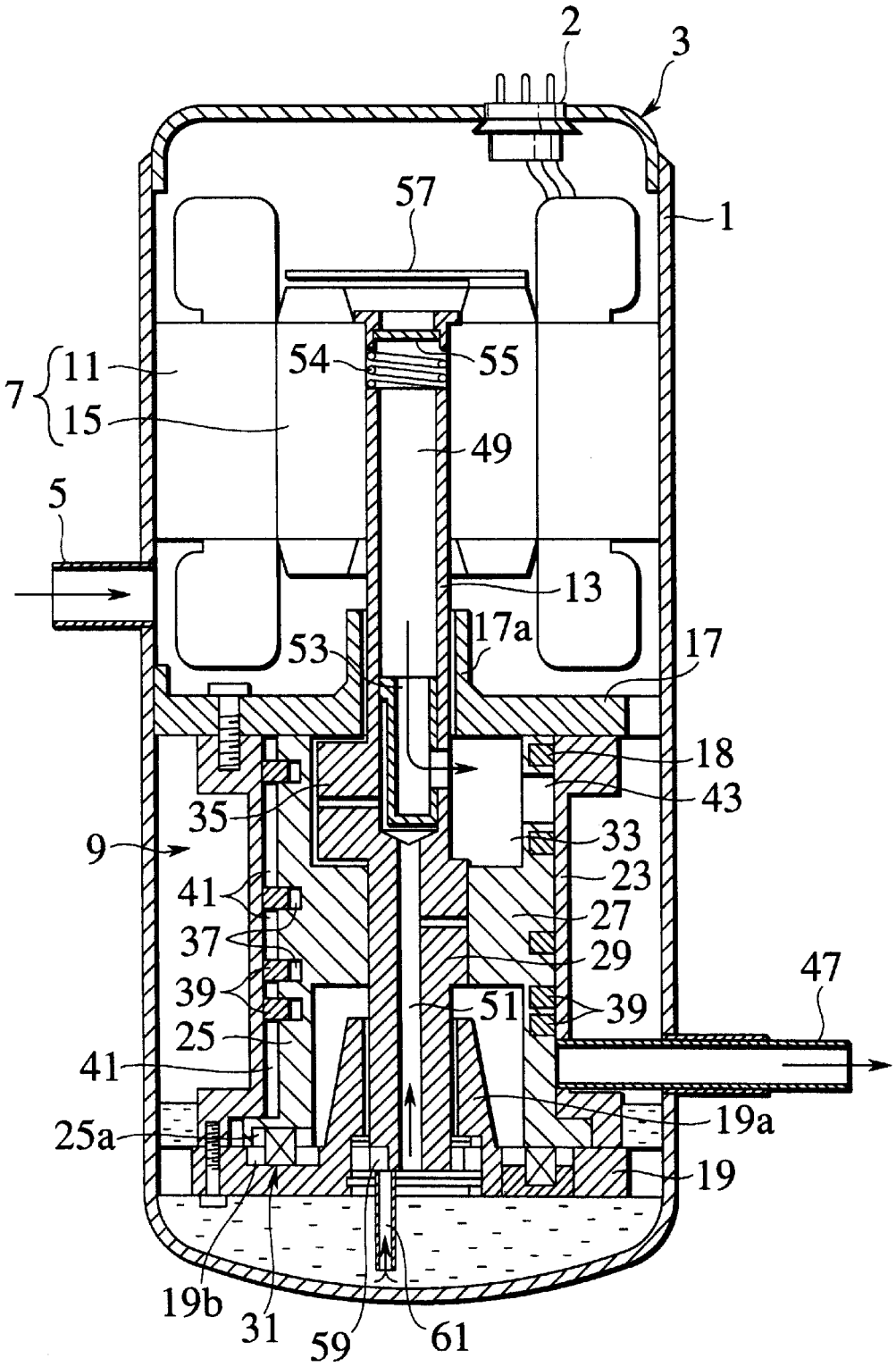
FIG. 8 is a sectional view showing a modification based on the fluid machine of FIG. 7 with an intake pipe being arranged between a drive mechanism and a compression mechanism.

FIG. 8 shows a modification based on the fluid machine of FIG. 7. This modification arranges the intake pipe 5 between the drive mechanism 7 and the compression mechanism 9. Gas sent into the casing 1 flows toward the intake passage 49 while cooling the drive mechanism 7 to improve the efficiency of the drive mechanism 7.

Although the embodiments and modifications explained above relate to compressors, the present invention is also applicable to expansion machines, pumps, etc.

In summary, the present invention provides a helical-blade fluid machine whose casing is filled with a low-pressure atmosphere and whose lubricant in the casing is free from high temperature or high pressure, and therefore, maintains proper viscosity. A compression mechanism of the fluid machine may be installed at a lower part of the casing to reduce the head of lubricant and surely lubricate bearings and the compression mechanism. The low-pressure atmosphere in the casing allows the well of the casing to be thin to reduce the weight thereof.

The fluid machine separates coolant gas and liquid sent into the casing from each other, and therefore, draws no coolant liquid into compression chambers, thereby preventing an overload operation. The coolant gas and liquid in the casing are used to cool a drive mechanism of the fluid machine, to improve the operation efficiency of the fluid machine.

Various modifications will become possible for those skilled in the art after receiving the teachings of the present disclosure without departing from the scope thereof.

What is claimed is:

1. A helical-blade fluid machine comprising:

a closed casing;

a cylinder arranged in the casing;

a roller eccentrically arranged in the cylinder;

a helical blade having unequal pitches to define compression chambers between the cylinder and the roller such that the volumes of the compression chambers gradually decrease in an axial direction;

a drive mechanism for swaying the roller with respect to the cylinder, to axially move each of the compression chambers so that the volume of each compression chamber gradually decreases to compress gas contained therein;

an intake pipe connected to the casing to guide gas into the casing and fill the casing with a low-pressure atmosphere; and a discharge pipe communicating with a discharge-end of one of the compression chambers, to guide compressed gas from the discharge-end of the compression chamber to the outside of the casing;

wherein the cylinder, roller, and helical blade form a compression mechanism and the drive mechanism for driving the compression mechanism is electrical and is disposed under the compression mechanism; and wherein the compression mechanism draws gas from a lower part thereof and compresses the gas in the compression chambers while conveying the gas upwardly.

2. The fluid machine of claim 1, wherein the compression mechanism draws gas from the peripheral face of the cylinder into the compression chambers.

3. The fluid machine of claim 1, wherein the compression mechanism draws gas from a lower part of the roller into the compression chambers.

4. The fluid machine of claim 1, further comprising:

a lubricant passage formed through a first support frame that supports a shaft of the compression mechanism such that the shaft can rotate, for passing lubricant that has lubricated bearings of the compression mechanism and dropping the lubricant onto a stator area of the drive mechanism.

5. A helical-blade fluid machine comprising:

a closed casing;

a cylinder arranged in the casing;

a roller eccentrically arranged in the cylinder;

a helical blade having unequal pitches to define compression chambers between the cylinder and the roller such that the volumes of the compression chambers gradually decrease in an axial direction;

a drive mechanism for swaying the roller with respect to the cylinder, to axially move each of the compression chambers so that the volume of each compression chamber gradually decreases to compress gas contained therein;

an intake pipe connected to the casing to guide gas into the casing and fill the casing with a low-pressure atmosphere; and a discharge pipe communicating with a discharge-end of one of the compression chambers, to guide compressed gas from the discharge-end of the compression chamber to the outside of the casing;

wherein the cylinder, roller, and helical blade form a compression mechanism and the drive mechanism for driving the compression mechanism is electrical and is disposed under the compression mechanism; and a first volume chamber formed in the cylinder and communicating with a discharge end of one of the compression chambers; and a second volume chamber formed above the cylinder and communicating with the first volume chamber.

6. The fluid machine of claim 5, wherein the cross-sectional area of the first volume chamber is tapered to widen toward the second volume chamber.

7. The fluid machine of claim 5, further comprising:

a check valve arranged in a port that connects the first and second volume chambers to each other, for blocking a reverse flow from the second volume chamber toward the first volume chamber.

8. The fluid machine of claim 5, further comprising:

an annular seal arranged around one of the second volume chamber and an end face of the roller, for sealing a high-pressure area from a low-pressure area.

9. The fluid machine of claim 8, wherein the center of the annular seal is aligned with the center of the shaft.

10. The fluid machine of claim 5, further comprising:

a second support frame serving as the bottom of the second volume chamber and having a bearing for supporting the top end of the shaft such that the shaft can rotate.

11. The fluid machine of claim 10, further comprising:

a lubricant passage axially formed through the shaft, and a bearing space formed between the top end of the shaft and the second support frame, the lubricant passage and bearing space passing lubricant to lubricate the bearing of the second support frame.

12. The fluid machine of claim 11, wherein the lubricant passage formed through the shaft is eccentric with respect to the axis of the shaft.

13. The fluid machine of claim 12, wherein the lubricant passage formed through the shaft communicates with a lower part of a bearing of the first support frame and an upper part of a bearing of the roller.

14. The fluid machine of claim 11, wherein the shaft is shared by the drive mechanism and compression mechanism, and an end of the shaft passed through the drive mechanism is supported by a third support frame such that the shaft can rotate.

15. A helical blade fluid machine comprising:

a closed casing;

a cylinder arranged in the casing;

a roller eccentrically arranged in the cylinder;

a helical blade having unequal pitches to define compression chambers between the cylinder and the roller such that the volumes of the compression chambers gradually decrease in an axial direction;

a drive mechanism for swaying the roller with respect to the cylinder, to axially move each of the compression chambers so that the volume of each compression chamber gradually decreases to compress gas contained therein;

an intake pipe connected to the casing to guide gas into the casing and fill the casing with a low-pressure atmosphere; and a discharge pipe communicating with a discharge-end of one of the compression chambers, to guide compressed gas from the discharge-end of the compression chamber to the outside of the casing;

first and second balancers fixed to the shaft in the roller of the compression mechanism.

16. The fluid machine of claim 1, further comprising:

a terminal fitting attached to the casing in a space that is formed on the casing and faces the cylinder of the compression mechanism, for supplying power to the drive mechanism.

17. The fluid machine of claim 16, further comprising:

a sway mechanism for swaying the roller with respect to the cylinder without rotating the roller, the sway mechanism being arranged between the bottom face of the roller and a lubricant passage area that is formed on a first support frame for rotatively supporting the shaft, to drop lubricant onto a stator area of the drive mechanism.

* * * * *